United States Patent [19]

Nakazawa

[11] Patent Number: 4,884,837

[45] Date of Patent: Dec. 5, 1989

[54] HANDLE FITTING STRUCTURE FOR PACKAGING BOX

[75] Inventor: Masahiro Nakazawa, Tokyo, Japan

[73] Assignee: Kabushiki Kaisha P C Planning, Shinjuku, Japan

[21] Appl. No.: 187,207

[22] Filed: Apr. 28, 1988

[30] Foreign Application Priority Data

Aug. 3, 1987 [JP] Japan ..... 62-119560

[51] Int. Cl.[4] ..... B65D 5/46

[52] U.S. Cl. ..... 294/158; 229/DIG. 6; 229/117.25

[58] Field of Search ..... 294/158, 167, 27.1; 2294/52 A, DIG. 6

[56] References Cited

U.S. PATENT DOCUMENTS

| | | | |
|---|---|---|---|
| 2,401,664 | 6/1946 | Robins | 229/52 A |
| 2,405,914 | 8/1946 | Van Rosen | 229/52 A |
| 3,726,470 | 4/1973 | Naylor | 229/52 A |
| 3,927,812 | 12/1975 | Winters et al. | 229/52 A |

*Primary Examiner*—Dennis H. Pedder
*Assistant Examiner*—Gary C. Hoge
*Attorney, Agent, or Firm*—Armstrong, Nikaido, Marmelstein, Kubovcik & Murray

[57] ABSTRACT

Disclosed herein is a handle fitting structure for a packaging box for holding cakes, a potted plant, or the like. Namely, it represents a fitting structure of a handle to a box body for a packaging box formed by engaging the tips of a bandlike handle with the box body made of an elastic material such as corrugated fiberboard. The fitting structure is provided at each of the two opposite positions on side walls of the box body. The structure includes an insertion slit, with a breadth greater than the handle breadth, through which the tip of the handle is inserted and engaged therewith, an insertion guide provided protrusively from the end of the handle and serving as a guide at the time of insertion of the tip of the handle into the insertion slit, and an engaging part provided at the tip of the handle protruding in the direction opposite to the insertion guide, and engages with the side wall at the upper edge of the insertion slit at the time of insertion of the tip of the handle. In accordance with such a fitting structure for a packaging box, the constitution is simple, fitting work of the handle to the box body is easy, and yet a sufficient attaching strength can be obtained.

6 Claims, 6 Drawing Sheets

(A)

(B)

(A)

(B)

(C)

HANDLE FITTING STRUCTURE FOR PACKAGING BOX

BACKGROUND OF THE INVENTION

1. Field of the Invention

The present invention relates to a handle fitting structure of a packaging box for accommodating, for example, cakes or a potted plant, and more particularly to a fitting structure of a bandlike handle to a box body of a packaging box formed by engaging both ends of the handle to opposite positions of the box body.

2. Description of the Prior Art

Conventionally, for a packaging box which is handed to a customer at the store front or the like by accommodating cakes, candies, small items, or the like, it has been customary to provide a handle for ease of carrying the box. In such a case, a bandlike handle made of paper or synthethic resin with certain degree of rigidity has been used in order to keep a predetermined shape of the handle while the box is being carried. Moreover, the handle is arranged to be fitted to the box as need arises with a structure such as shown in FIGS. 1 and 2 to enable its attachment to the box. Namely, the fitting structure of the handle is formed by protrusively providing a pair of projections for engaging 2 and 2 at the upper ends of the opposite positions of the side walls of a box body 1, and by engaging both ends of a bandlike handle 3 with the respective projections 2. In this case, there is formed an inwardly bent engaging hook 4 on each end of the handle 3, and on each of the projections 2 there is provided a horizontal slit 5 with a breadth substantially corresponding to the band breadth for inserting the tip of the hook 4 therethrough. The hook 4 is passed through the slit 5 and engaged thereto, as shown in FIG. 1.

The handle fitting structure as described in the above is convenient in that it is possible to attach the handle 3 to the box as needed at the store front or the like to hand it to a customer. However, in such a conventional structure, the projections 2 have been cumbersome due, for example, to their breakage caused by the mishandling of the box, in addition to the necessity of providing the projections 2 which protrude from the top surface of the box body 1, which makes the box structure more complex. Furthermore, stacking of the boxes is impossible due to the presence of the projections 2, and moreover, there is a drawback that the handle 3 tends to be disengaged when its ends are lowered downwardly for some reason.

Moreover, ina structure like in the above, the hooking part of the hook 4 and the slit 5 on the projection 2 are engaged with each other by making a contact along a horizontal line, so that when the handle 3 is carried together with other baggages, for example, the body of the box 1 is inclined corresponding to the inclination of the handle 3 with respect to the vertical direction, giving rise to a drawback that cakes, soft Japanese pastries, or the like held inside the box undergo a deformation.

Still further, as a packaging box for accommodating a potted plant or the like, there is known one which is obtained by cutting open the top lid of a box body 1 as shown in FIG. 1, accommodating a pot, and stuffing the space between the outer periphery of the pot and the side walls of the box body with paddings like newspaper sheets.

However, in addition to the persistance of the above-mentioned problems in this kind of packaging box for potted plants, there used to be a problem that the branches, leaves, and the like are damaged by the bandlike handle 3, when the branches, leaves, and flowers of a potted plant extend beyond the outer periphery of the pot, deteriorating the original appearance of the plant.

SUMMARY OF THE INVENTION

The main object of the present invention which was contrived in view of the above-mentioned problems, is to provide a handle fitting structure for a packaging box which allows as needed a quick and simple attaching of a handle that is prepared separately, without providing projections for engaging with the handle protruding from the top surface of the box.

Another object of the present invention is to provide a handle fitting structure which possesses a sufficient attaching strength to the box body in spite of its simple structure.

Another object of the present invention is to provide a handle fitting structure for a packaging box which can maintain the body of a box in an approximately horizontal position even when the handle is carried, along with other baggages or the like, making an inclination with respect to the vertical direction.

Still further object of the present invention is to provide a handle fitting structure for a packaging box that the handle thereof will not give damages to branches, leaves, flowers and the like of a potted plant that extend beyond the pot which is accommodated within the box body.

In order to solve the above-mentioned problems, in a packaging box formed by arresting both ends of a bandlike handle to the body of a box made of an elastic member, the fitting structure of a handle for a box body according to the present invention comprise an insertion slit formed by incision with breadth greater than the handle breadth, which is provided at one of the mutually opposite positions on the side walls of the box body and through which the tip of the handle is inserted and restrained there, a tonguelike insertion guide, provided protrusively on the tip of the handle, for serving as guide for insertion of the tip into the insertion slit, and an engaging member for engaging with the side wall of the box body at the upper edge of the insertion slit when the tip of the handle is inserted into the insertion slit, and the engaging member being provided on the tip of the handle protruding in the direction opposite to that of the insertion guide.

Moreover, in order to stably maintain the box body itself in an approximately horizontal position when the handle is held so as to make an inclination with the vertical direction, the insertion slit is formed in an arc form curving convexly upward and an engaging part of the engaging member is formed in an arc form so as to restrain the engaging part to the side wall of the box body at the upper edge of the insertion slit under a state of point contact.

Furthermore, in order to prevent the damages by the handle to the branches and leaves of a potted plant accommodated in the box, the present invention further comprises a platelike member, which is placed freely attachably and detachably over the upper opening of the box body, with an opening at the central portion for accommodating a pot or the like. The outer periphery of the platelike member is formed into a supporting plate of collar-form which extends toward the outside of the box body, and there are provided a pair of positioning openings at the opposite positions of the outer periphery of the supporting plate so as to hold the handle at a predetermined position which does not harm the branches and leaves of the potted plant.

By the use of the handle fitting structure with the above constitution according to the present invention, the handle can securely be attached to the box body by merely inserting and retaining both of its ends through the respective insertion slits that are formed at the opposite positions on the side walls of the box body. Accordingly, there is no need for providing engaging projections on the top surface of the box body as is done in the above-mentioned conventional packaging box. Hence, the structure of the box body can be simplified, and moreover, there is obtained an advantage that the box bodies can be stacked one over the other. In addition, the handle is attached directly to the side walls of the box body so that the attaching strength of the handle can be enhanced compared with the case of providing the projections like the conventional packaging box.

Moreover, constituting the engaging part so as to be held by the side wall at the upper edge of the insertion slit by forming the insertion slit in an arc form curved convexly upward and forming the engaging part of the engaging member provided on the tip of the handle in a circular form, as mentioned earlier, the box body can always be maintained in a stable horizontal state since the point of contact between the engaging part and the side wall at the upper edge of the insertion slit can move along the upper edge due to the self-weight of the box body. Because of this, deformation of cakes or the like accommodated within the box body can also be prevented.

Furthermore, by attaching a supporting plate, which has an opening for accommodating a pot and has an outer peripheral portion extending outwardly in collar-form from the box body, freely attachable to and detachable from the upper opening of the box body, and by holding the handle with a pair of positioning holes provided at opposite positions on the outer peripheral portions of the supporting plate, as described earlier, the handle can be located at a position away from the side walls of the box body, so that damages by the handle to the branches, leaves, and flowers of the potted plant that extend toward the outside of the box body can be prevented when the packaging box is carried by holding the handle.

These and other objects and advantages of the present invention, as well as the details of an illustrative embodiments, will be more fully understood from the following specification and drawings in which:

BRIEF DESCRIPTION OF THE DRAWINGS

FIGS. 5(A), 5(B), and 5(C) show respectively the different aspects of the fitting structure of the handle to the box body, in which FIG. 5(A) is a sectional view that shows the inserting state of the handle tip, FIG. 5(B) is a rear view that shows the state after attachment of the handle, and FIG. 5(C) is a sectional view of the attached state.

DETAILED DESCRIPTION OF THE PREFERRED EMBODIMENTS

Figure 1:
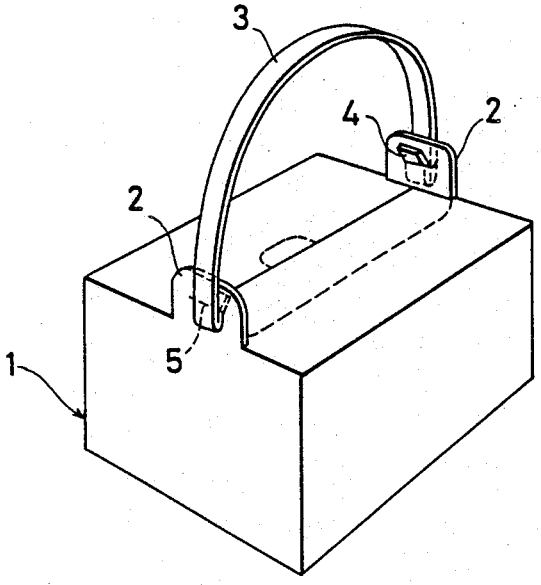
FIG. 1 PRIOR ART
FIG. 1 is a perspective view which illustrates a conventional handle fitting structure for a packaging box.
Figure 2:
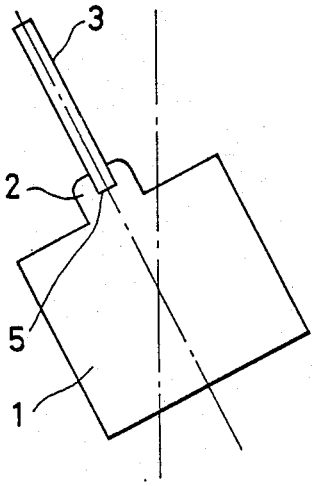
FIG. 2 PRIOR ART
FIG. 2 is an explanatory diagram for illustrating a problem in the conventional packaging box.
Figure 3:
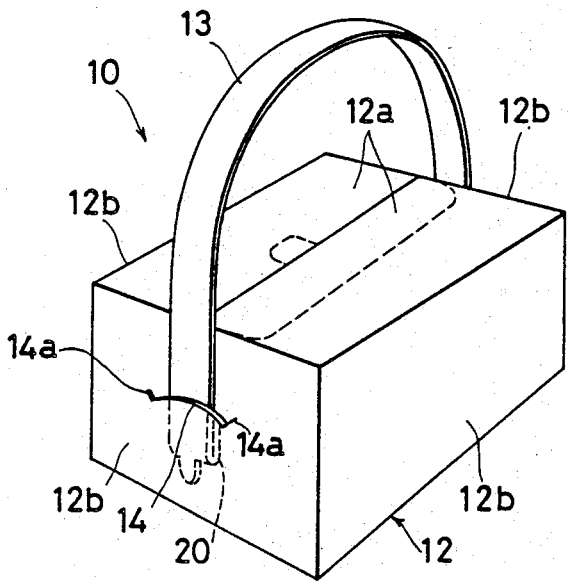
FIG. 3 is a perspective view of a packaging box equipped with a handle fitting structure in accordance with the present invention.

FIG. 3 shows an embodiment of the packaging box equipped with a handling structure of the present invention. The packaging box 10 has a box body 12 made of a cardboard such as corrugated fiberboard. The box body 12 is equipped with lid members **12*a* and 12*a* that can be opened and closed from the respective edges of the top surface. The box body 12 is formed of an approximately rectangular parallelepiped box with two pairs of opposite side walls 12*b* and 12*b*, and can accommodate in its inside cakes or the like by opening the lid members 12*a* and 12*a***.

To the respective opposite side walls **12*b* and 12*b* that form the end surface in the longitudinal direction of the box body 12, there are inserted and engaged the respective ends of a bandlike handle 13 formed by a band or the like made of paper or synthetic resin with a predetermined thickness and elasticity and a predetermined rigidity. Namely, at a position below approximately the central part of each of the side walls 12*b* and 12*b* in the longitudinal direction, there is formed an insertion slit 14. The insertion slit 14 has on its both ends an upwardly concave or bent recess path 14*a* for preventing the cracking of the insertion slit 14 and for facilitating the insertion of the tip of the handle 13 and also for securing its engagement with an engaging part which will be described late, provided on the end of the handle 13. The insertion slit 14 has a breadth which is slightly larger than that of the handle 13, and is formed by an incision which is horizontal or curved convexly upward. The insertion slit 14** may also be formed by an oblong aperture with a fixed vertical width.

Figure 4:
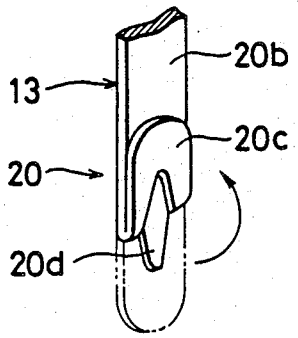
FIGS. 4(A) and 4(B) are a perspective view and an explanatory diagram, respectively, for showing the structure of the tip section of the handle according to an embodiment of the handle fitting structure of the present invention.
Figure 4:
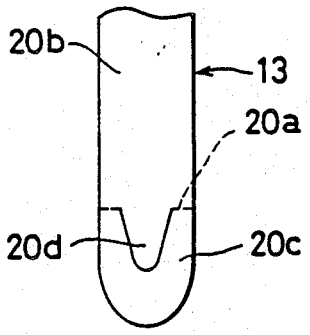

On both ends of the handle 13, there are provided engaging parts 20 and 20. The engaging part 20 is formed, as illustrated in FIGS. 4 and 5, by folding the tip portion of the handle 13 along a folding line 20*a* onto one side of a bandlike part 20*b* of the handle 13 and fixing it thereon with an adhesive or a rivet such as an eyelet or the like. The top section of the folded engaging part 20 forms an upwardly convex circular part 20*c* as shown in the figures. The engaging point of the circular part 20*c* is engaged with the side wall of the box body 12 at the upper edge of the insertion slit 14 under a condition of point contact or close to it, as shown in FIG. 5(B), in such a way that both of the engaging parts 20 are kept in a state mutually rollable along the circular arc of the upper edges of the insertion slits 14, respectively, thereby permitting a rocking motion in the left-right direction of the handle 13 with respect to the box body 12.

Figure 5:
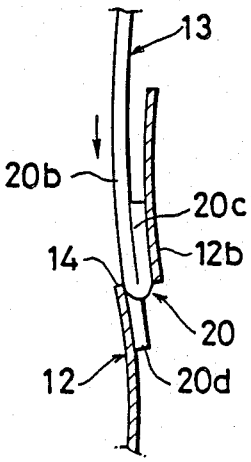
Figure 5:
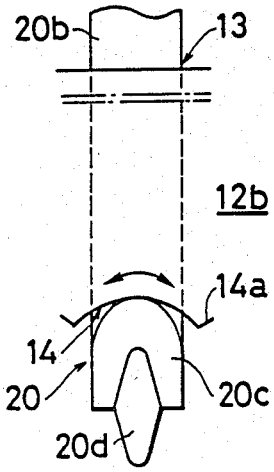
Figure 5:
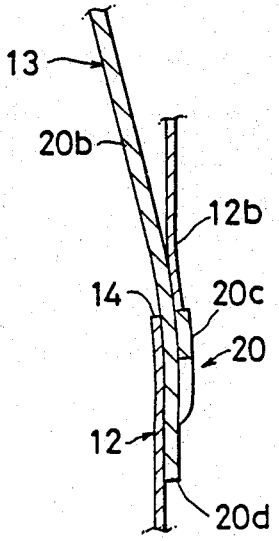

Further, at the center of each of the ends of the handle 13, there is protruded a bell-shaped tonguelike piece 20*d*, which is formed by remaining as an extended end of the bandlike part 20*b* without being provided with a folding line 20*a*, as shown in FIGS. 4 and 5. The bell-shaped tonguelike piece 20*d* has a function facilitating the insertion into the insertion slit 14, and preventing the slipping-out of the engaging part 20 from the slit 14. The entirety of the handle 3 need not necessarily to be formed into a bandlike form, and the grip section at the central part in the longitudinal direction of the handle may be made narrower having a circular cross-section, or the like.

Figure 7:
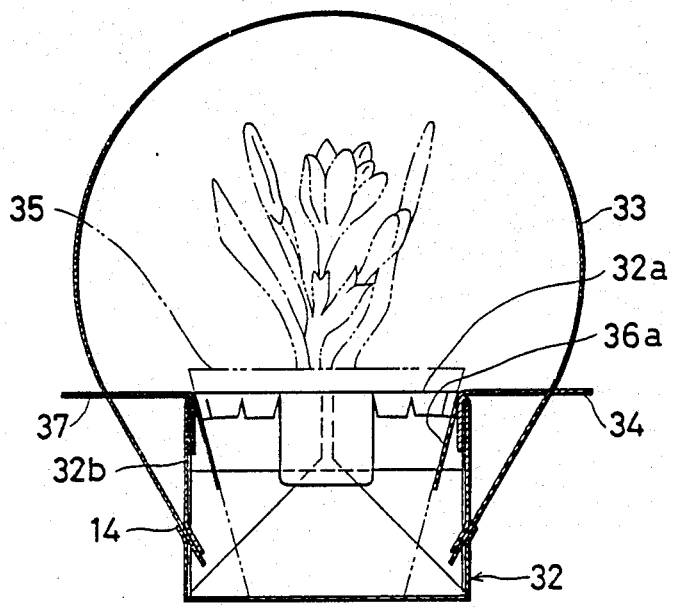
FIG. 7 is a sectional view which shows the usage condition of the packaging box for accommodating a potted plant described in FIG. 6.
Figure 6:
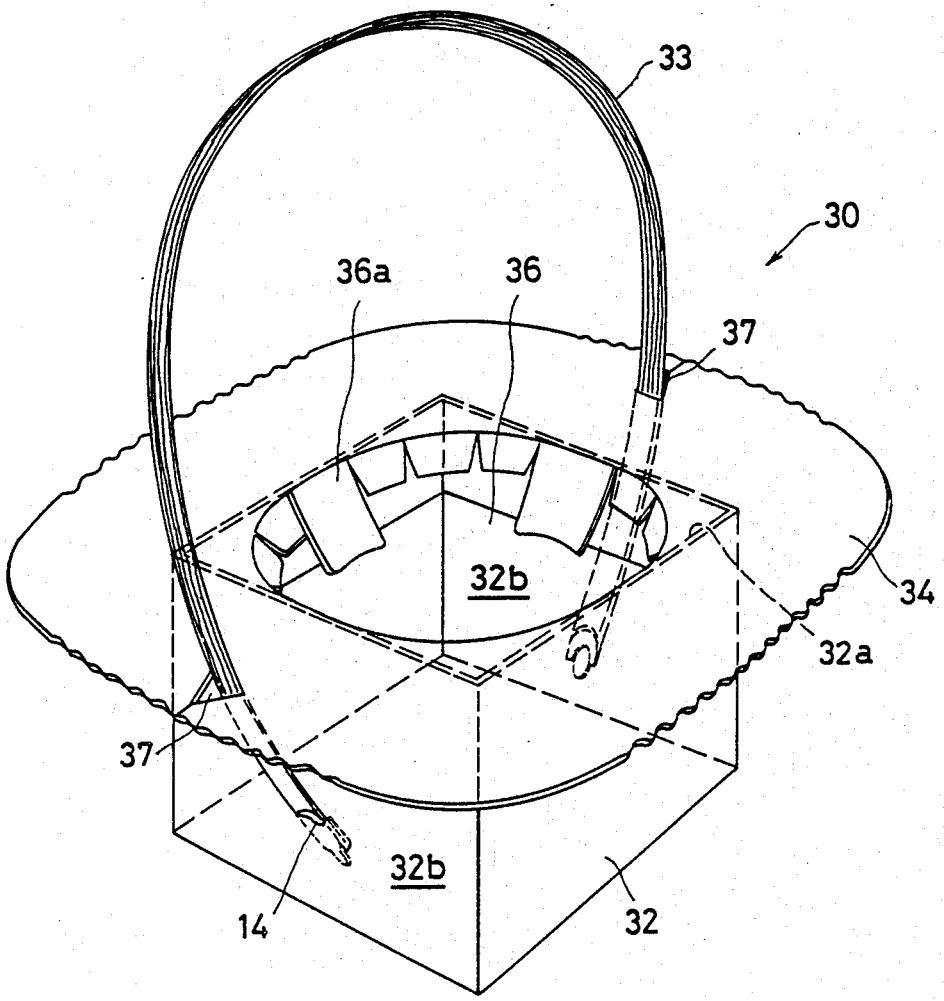
FIG. 6 is a perspective view of a packaging box for potted plants equipped with the fitting structure of the handle described in FIG. 4.

FIGS. 6 and 7 show a case in which the handle fitting structure of the above embodiment is applied to a packaging box 30 for potted plants. Namely, the packaging box 30 is equipped with a box body 32 made of corrugated fiberboard or the like that has an upward opening 32*a*, a bandlike handle 33 which is engaged with the opposite side walls 32*b* and 32*b* of the box body 32, and a supporting plate 34 which can be freely attached to and detached from the box body 32. Therefore, as illustrated in FIG. 7, a potted plant 35 or the like can be accommodated stably within the box body 32 through an accommodation hole 36 which is partitioned and formed at the central part of the supporting plate 34.

The handle 33 which has the structure as described in connection with FIGS. 4 and 5 can be inserted through insertion slits 14 formed on the opposite side walls 32*b* of box body 32 and retained there.

Further, the handle 33 is inserted through positioning holes 37 provided on the opposite sides of the supporting plate 34 that correspond to the insertion slits 14 on the box body 32 to be held in a form which gives no fear of damaging the branches, leaves, and the like of a potted plant 35 accommodated within the box body 32. That is, the supporting plate 34 consists of a platelike member made of cardboard with approximately rectangular shape, with its outer periphery having dimensions and shape that extends from the side walls 32*b* and 32*b* of the box body 32, as may be clear from FIGS. 6 and 7.

On the inner edges of the accommodation hole 36 provided at the central part of the supporting plate 34, there are consecutively provided guide flaps 36*a* that are bent downward in a state retaining elasticity. With this arrangement, when the potted plant 35 is accommodated in the accommodation hole 36, a pot of the potted plant 35 can be held pushed by the guide flaps 36*a* in a stable condition. Namely, even when the size of the pot of the potted plant 35 to be accommodated vary to some extend, it is possible to carry the pot by accommodating it in a stable state by the help of the elastic force provided by the guide flaps 36*a*.

Further, the positioning holes 37 provided in the outer periphery of the supporting plate 34 consist of triangular notches for inserting and clipping the bandlike handle 33 which is held by the positioning holes 37 unless taken out intentionally.

As described in the above, in such a packaging box for potted plants, the handle 33 is arranged to be inserted through the positioning holes 37 provided in the outer periphery of the supporting plate 34 and is located at a position considerably away from the side walls 32*b* and 32*b* of the box body 32. Owing to this, the handle 33 will not damage the branches and leaves of the potted plant or the like which extend to the outside of the box body 32. Moreover, even when the packaging box 30 is toppled, the soil and plant inside the pot can be prevented from being spilled out, since the pot 35 can be supported without falling completely sideways by the help of the supporting plate 34.

Figure 8:
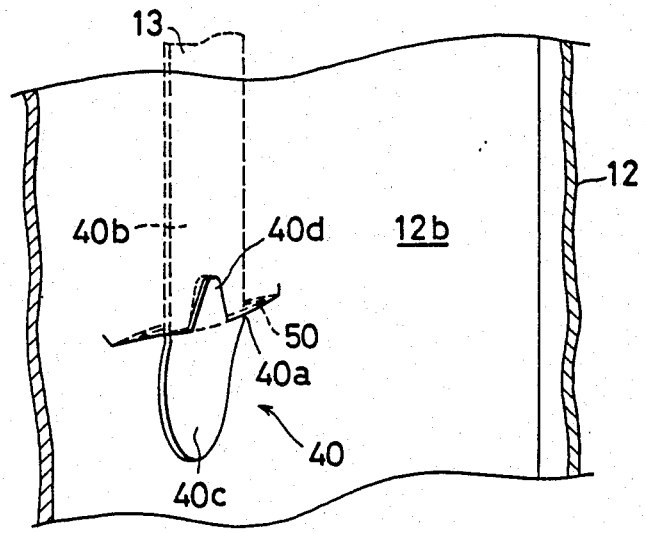
FIG. 8 is a perspective view which shows a second embodiment of the handle fitting structure in accordance with the present invention.
Figure 9:
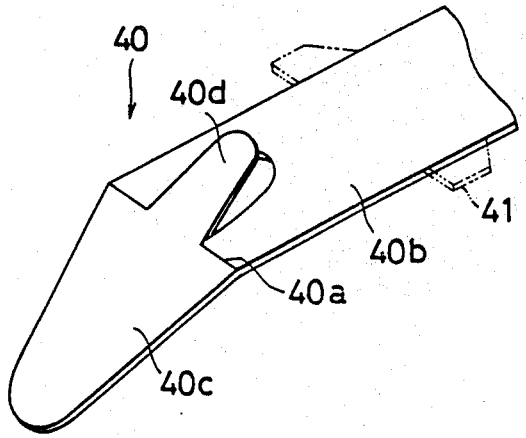
FIGS. 9(A) and 9(B) are a perspective view which shows the structure of the handle tip section, and a sectional view which shows the attached state of the handle to the box body, respectively, of the handle fitting structure according to the second embodiment of the present invention.
Figure 9:
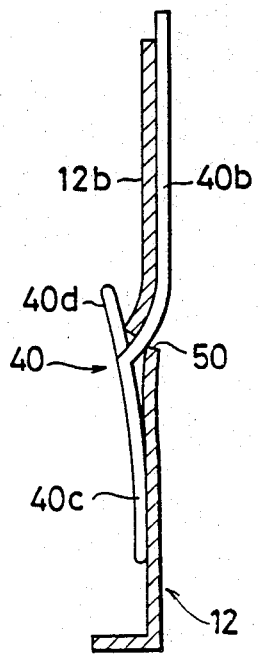

FIGS. 8 and 9 illustrate another embodiment of the present invention. Namely, in the handle fitting structure in accordance with this embodiment the engaging parts 40 and 40 formed on the tips of the handle 13 are produced by bending the respective tips of a bandlike part 40*b* to one side at a folding line 40*a* to form an insertion part 40*c*. The insertion part 40*c* is formed into an acutely pointed form with a curved portion on its tip to facilitate its insertion into the insertion slit 50. In addition, at the center of the base edge part of the insertion part 40*c*, there is formed by punching a tonguelike engaging piece 40*d* extending in the direction opposite to that of the insertion part 40*c*, and the base edge section of the engaging part 40*d* engages with the side wall 12*b* at the upper edge of an insertion slit 50 which consists of a horizontal incision provided on the side wall 12*b* of the box body 12 to prevent the slipping-out of the handle 13. The engaging piece 40*d* may be prepared separately, differing from what was described in the above, and fixed to the handle 13 with an adhesive or the like.

In a constitution as in the above, the insertion part 40*c* is inserted from the outside of the box body 12 into the insertion slit 50 with the engaging piece 40*d* kept on the inner side until the engaging piece 40d of the engaging part 40 enters completely to the inside of the box body 12. Then, by pulling up the handle 13 the side wall 12*b* at the upper edge of the insertion slit 50 engages with the engaging piece 40*d* of the engaging part 40, as shown in FIGS. 8 and 9(B), inhibiting the slipping-out of the handle 13. In addition, by an elastic deformation of the insertion part 40*c*, the tip of the insertion part 40*c* is pressed against the inner side of the side wall 12*b* to enhance the fixation of the handle 13 to the box body 12.

FIGS. 10(A) and 10(B) and FIGS. 11(A) and 11(B) show still other embodiments of the present invention.

Figure 10:
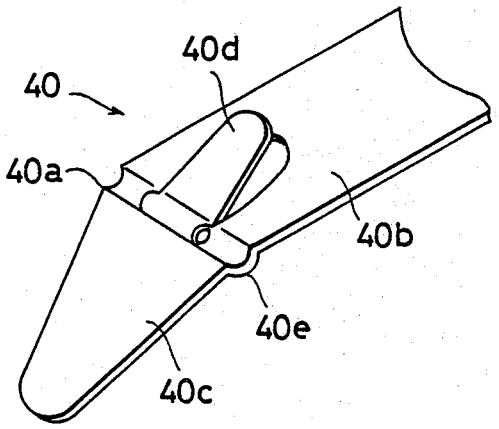
FIGS. 10(A) and 10(B) are a perspective view which shows the structure of the handle tip part, and a sectional view which shows the attached state of the handle to the box body, respectively, of the handle fitting structure according to a third embodiment of the present invention.
Figure 10:
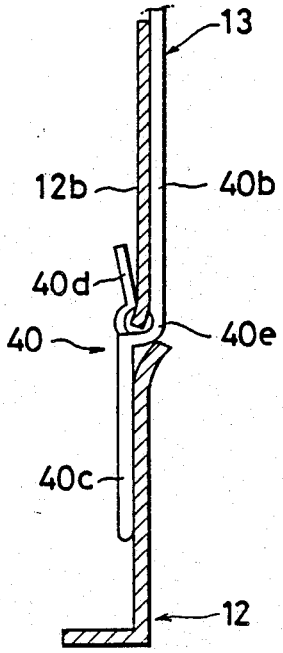

In the embodiment shown in FIGS. 10(A) and 10(B), by the formation of a curved portion 40*e*, at the folding line 40*a* of the base edge of the insertion part 40*c* of the engaging part 40 of the handle 13, in the direction of the bending of the insertion part 40*c*, there is generated a more powerful elastic force for the bent form. In this case, the engagement of the handle 13 with the box body 12 can be made securely by causing the side wall 12*b* at the upper edge of the insertion slit 50 to be engaged with the carved portion 40*e*, as shown in FIG. 10(B).

Figure 11:
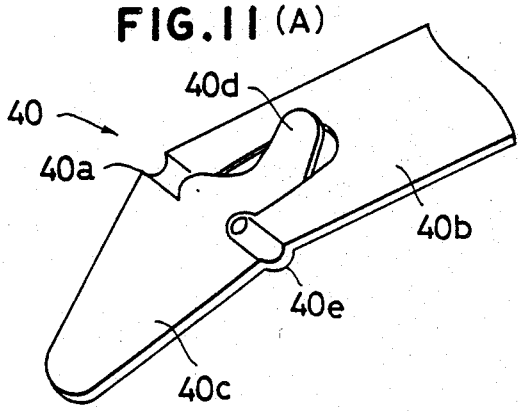
FIGS. 11(A) and 11(B) are a perspective view which shows the structure of the handle tip part, and a sectional view which shows the attached state of the handle to the box body, respectively, of the handle attaching structure according to a fourth embodiment of the present invention.
Figure 11:
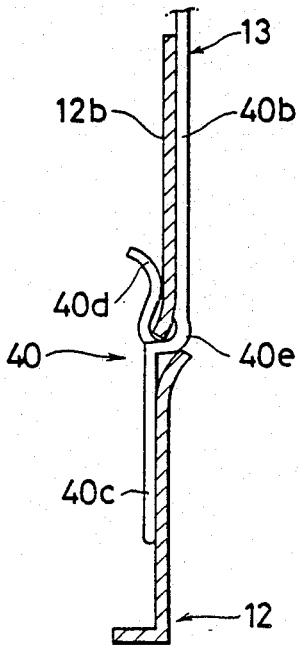

Further, in another embodiment shown in FIG. 11(A), the clipping action of the side wall at the upper edge of the insertion slit 50 can be created as illustrated in FIG. 11(B) by shaping the engaging piece 40*d* in a wavy form. With such a construction, a secure fixing of the handle 13 can be achieved by the clipping action due to the engaging piece 40*d* which becomes available in addition to the effect realizable by the previous embodiment.

On the other hand, stoppers 41 may be protruded from both sides in the upper portion the engaging part 40, as indicated by the imaginary line in FIG. 9(A), so as to give the handle 13 a local width which is greater than that of the insertion slit 50. In this case, the tips of the handle 13 are restrained from protruding into the box body 12 more than necessary so that damages to the content of the box body 12 such as cakes can be prevented effectively.

Figure 12:
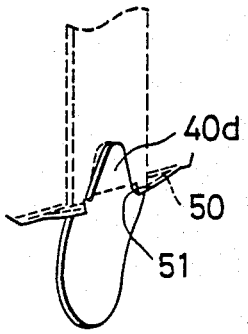
FIG. 12 is a perspective view which shows an improved example of the handle insertion incision.

As for the shape of the insertion slit 50, there may be adopted one in which there is formed at its central part an indentation 51 adapted for engagement with the engaging piece 40*d* of the engaging part 40, as shown in FIG. 12. By the formation of such an identation 51 there can be obtained an advantage that the insertion of the engaging piece 40*d* into the insertion slit 50 is facilitated, in addition to obtaining a secure engagement of the handle 13 by the suppression of the horizontal movement of the engaging piece 40*d*. As for the shape of the indentation 51 it may be semi-circular as well as rectangular.

It will be apparent from the foregoing description that the handle fitting structure of the present invention has a number of advantages, some of which have been described above. Also, obvious modifications and variations can be made to the handle fitting structure of the present invention without departing from the scope of the invention. Accordingly, the scope of the invention is not limited as necessitated by the accompanying claims.

What is claimed is:

1. A handle fitting structure for a packaging box which has a box body having side walls and a band-like handle attached to said box body by engaging both tips thereof with said side walls of said box body, said fitting structure comprising:

insertion slit means for inserting said tips of said handle therethrough and engaging thereto, said insertion slit means including a curved incision having a length greater than a width of said handle and provided at each of two facing side walls of said box body;

insertion guide means for serving as a guide at the time of inserting said tips of said handle into said insertion slit means, and said insertion guide means being extended protrusively in a first direction on each of said tips of said handle; and engaging means for engaging with a curved upper edge of said curved incision when each of said tips of said handle is inserted into said insertion slit means, and said engaging means being provided on each of said tips of said handle in a direction opposite to said first direction of said insertion guide means and having a curved tip end such that said box body is swingably supported by said handle by the engagement of said curved tip end of said handle with said curved upper edge of said incision of said box.

2. A handle fitting structure for a packaging box as claimed in claim 1, wherein each of said insertion guide means has a tongue-like shape for facilitating the insertion of said tip of the handle into said insertion slit means.

3. A handle fitting structure for a packaging box as claimed in claim 2, wherein and angled slit is further provided at each of both ends of said curved incision for facilitating the insertion of said handle into said incision.

4. A handle fitting structure for a packaging box as claimed in claim 3, wherein each of said engaging means is formed by folding a part of each of said tips of said handle in a direction opposite to the first direction to form a layered structure in the vicinity of said tip of said handle such that the remaining part of said tip forms said insertion guide means.

5. A handle fitting structure for a packaging box as claimed in claim 1, wherein said handle fitting structure further comprises a substantially flat supporting plate on the top of said box body, said supporting plate has an aperture at the center thereof for accommodating a potted plant therein and further has a pair of positioning holes through which said handle passes.

6. The handle fitting structure for a packaging box as claimed in claim 5, wherein each of said positioning holes has a triangular shape.

* * * * *